US008919308B2

(12) United States Patent
Schober et al.

(10) Patent No.: US 8,919,308 B2
(45) Date of Patent: Dec. 30, 2014

(54) CLUTCH SHAFT, ACTUATOR, CAMSHAFT ADJUSTMENT TRANSMISSION AND CAMSHAFT CONTROLLER

(75) Inventors: Michael Schober, Behambe (AT); Felix Kuffner, Linz (AT)

(73) Assignee: MAGNA Powertrain AG & Co. KG, Lannach (AT)

( * ) Notice: Subject to any disclaimer, the term of this patent is extended or adjusted under 35 U.S.C. 154(b) by 318 days.

(21) Appl. No.: 13/487,210

(22) Filed: Jun. 3, 2012

(65) Prior Publication Data

US 2012/0309571 A1 Dec. 6, 2012

(30) Foreign Application Priority Data

Jun. 3, 2011 (DE) ..... 10 2011 103 495

(51) Int. Cl.
*F01L 1/34* (2006.01)
*F01L 1/352* (2006.01)

(52) U.S. Cl.
CPC ..... *F01L 1/352* (2013.01)
USPC ..... 123/90.17; 464/102; 464/106

(58) Field of Classification Search
USPC ..... 123/90.15, 90.17, 90.31; 192/110 R, 192/110 S; 464/102–106
See application file for complete search history.

(56) References Cited

U.S. PATENT DOCUMENTS 3,955,378 A * 5/1976 Allonca ..... 464/106

* cited by examiner

*Primary Examiner* — Zelalem Eshete
(74) *Attorney, Agent, or Firm* — Jordan IP Law, LLC; Todd A. Vaughn

(57) ABSTRACT

A clutch shaft for a camshaft controller having at each of two ends (30, 31) thereof a rotating joint which equalizes the angle between the axes. An actuator for controlling a camshaft adjustment transmission includes a clutch shaft for controlling the camshaft adjustment transmission to the actuator via a first rotating joint which equalizes the angle between the axes which is coupled in a region of the actuator which faces away from the adjustment transmission.

19 Claims, 7 Drawing Sheets

CLUTCH SHAFT, ACTUATOR, CAMSHAFT ADJUSTMENT TRANSMISSION AND CAMSHAFT CONTROLLER

CROSS-REFERENCE TO RELATED APPLICATIONS

The present application claims priority under 35 U.S.C. §119 to German Patent Application No. 10 2011 103 495.5 (filed on Jun. 3, 2011), which is hereby incorporated by reference in its respective entirety.

FIELD OF THE INVENTION

The present invention relates to a clutch shaft for a camshaft controller, an actuator for controlling a camshaft adjustment transmission, a camshaft adjustment transmission which is also referred to hereinbelow as an "adjustment transmission," and a camshaft adjustment device for an internal combustion engine.

BACKGROUND OF THE INVENTION

German Patent Publications DE 10 2004 041 751 A1, DE 10 2007 049 072 A1 and DE 102 48 351 A1 disclose various clutches for equalizing an eccentricity (axial offset) between an axis of an actuating shaft of an actuator and an axis of an adjustment transmission. These clutches exert, in the case of corresponding radial axial offset of the corresponding shafts, forces of inertia on these shafts and their bearings. In the case of Oldham clutches, the large axial installation space requirement is also disadvantageous.

SUMMARY OF THE INVENTION

An object of the present invention is to provide a dutch shaft for a camshaft controller with which forces of inertia on these shafts and their bearings can be reduced. It is furthermore an object of the invention to provide an actuator, a camshaft adjustment transmission and a camshaft adjustment device structured to facilitate this advantage.

This object is achieved with a clutch shaft which includes at least one of the following: a clutch shaft body having a first end and a second end, each having a clutch component which equalizes the angle between the axes.

This object is achieved with an actuator for controlling a camshaft adjustment transmission, the actuator comprising: and actuator body; a clutch shaft configured to control the camshaft adjustment transmission, the clutch shaft being coupled to the actuator body via a first rotating joint which equalizes the angle between the axes in a region of the actuator body which faces away from the camshaft adjustment transmission.

This object is achieved with a camshaft adjustment transmission comprising: an adjustment shaft; a chainwheel at which the camshaft is guided through; a transmission drive gearwheel having an inner toothing and an outer toothing and configured to drive the adjustment shaft of adjustment transmission via a speed reduction with a intermediate gearwheels, wherein one of the inner tooting and the outer toothing comprises a denture clutch component.

In accordance with the invention, the clutch shaft for a camshaft controller is developed further in that the clutch shaft has at each of its two ends, in each case a clutch component, for in each case a rotating joint which equalizes the angle between the axes. Due to the fact that the clutch shaft in accordance with the invention has a clutch component at each of its two ends, it is possible to equalize an axial offset without a bringing about or enlargement of an axial angle between the actuator and the adjustment transmission having to be accepted as a result of this measure.

By dividing the axial offset adjustment between two clutches, the designer is given a greater degree of freedom which to exploit a reduction in the axial angle for the introduction of force into the actuator or into the adjustment transmission. By reducing the axial angle for the introduction of force into the actuator or into the adjustment transmission, a rotational symmetry of the force transmission is improved and a magnitude of the disadvantageous forces of inertia is reduced. The clutch shaft can, but need not be, in one-piece.

A (total) axial length of the clutch shaft can be greater than w % of a maximum diameter of the larger clutch component, wherein w % is at least 130%, in particular at least 150%. The clutch shaft can be tapered between its two ends across more than w % of its (total) axial length, wherein w % is at least 30%, in particular at least 60%. The clutch shaft can comprise on at least one of its two face sides a cylinder-symmetrical, convex formation which is arranged concentrically with respect to the main longitudinal axis of the clutch shaft. The clutch shaft can comprise a flange for a bearing.

The first rotating joint which equalizes the angle between the axes can comprise a fastening bolt or a component of a denture clutch, a claw clutch, a plug clutch, a driver clutch, a radial gearwheel clutch, a disc gearwheel clutch, a flexible disc, a bellows clutch, an elastomer clutch, a helix clutch, a spring clutch, a spring disc clutch, a fixed link clutch, a balancing clutch, a cardan transmission or a homokinetic joint. Independently of this, the second rotating joint which equalizes the angle between the axes can comprise a fastening bolt or a component of a denture clutch, a claw clutch, a plug clutch, a driver clutch, a radial gearwheel clutch, a disc gearwheel clutch, a flexible disc, a bellows clutch, an elastomer clutch, a helix clutch, a spring clutch, a spring disc clutch, a fixed link clutch, a balancing clutch, a cardan transmission or a homokinetic joint. The denture clutch component can comprise an arcuate denture clutch. The denture clutch component can have a spherical or spherical portion-shaped basic shape on which the teeth of the denture clutch component are arranged.

In accordance with the invention, the actuator is developed further in that a clutch shaft for controlling the camshaft adjustment transmission is coupled to the actuator by way of a first rotating joint which equalizes the angle between the axes in a region of the actuator which faces away from the adjustment transmission. As a result of this, in the case of an unchanged distance between actuator and camshaft adjustment transmission, the distance between the location of the connection, which can be angled, to the rotor and the camshaft adjustment transmission can be increased, as a result of which a reduction in the axial angle for the introduction of force into the adjustment transmission is achieved, a rotational symmetry of the transmission of force is improved and a magnitude of the disadvantageous forces of inertia is reduced.

The clutch shaft can extend across more than 50% of a (total) axial length of a rotor of the actuator. The clutch shaft can be arranged rotatably in the pitch direction in the actuator on each circumferential angle, wherein a pitch angle of the clutch shaft with respect to an axis of the actuator can be up to at least 1°, in particular up to at least 2°, particularly preferably up to at least 3°. The clutch shaft can be arranged axially displaceably in the rotor.

The actuator can comprise an axial bearing component for pretensioning the clutch shaft in the direction of the main longitudinal axis of the clutch shaft. The actuator can comprise a clutch shaft in accordance with the invention.

The first rotating joint which equalizes the angle between the axes can comprise, for coupling to the rotor, a fastening bolt or a component of a denture clutch, a claw clutch, a plug clutch, a driver clutch, a radial gearwheel clutch, a disc gearwheel clutch, a flexible disc, a bellows clutch, an elastomer clutch, a helix clutch, a spring clutch, a spring disc clutch, a fixed link clutch, a balancing clutch, a cardan transmission or a homokinetic joint.

In accordance with the invention, the camshaft adjustment transmission is further developed in that an inner or outer toothing of a transmission drive gearwheel of the camshaft adjustment transmission is formed or is suitable for the engagement of the denture clutch component of a clutch shaft or that the camshaft adjustment transmission comprises a clutch shaft.

The denture clutch component of the clutch shaft can form a floating transmission drive gearwheel of the camshaft adjustment transmission.

In accordance with the invention, the camshaft adjustment device is developed further in that it comprises an actuator and/or a cam adjustment transmission.

BRIEF DESCRIPTION OF THE DRAWINGS

The invention is described below by means of exemplary embodiments illustrated in the drawings in which show.

DETAILED DESCRIPTION OF EMBODIMENTS

The same reference numbers are used in each case for corresponding components in the figures. Explanations relating to reference numbers therefore apply across the figures unless otherwise apparent from the context.

Figure 1:
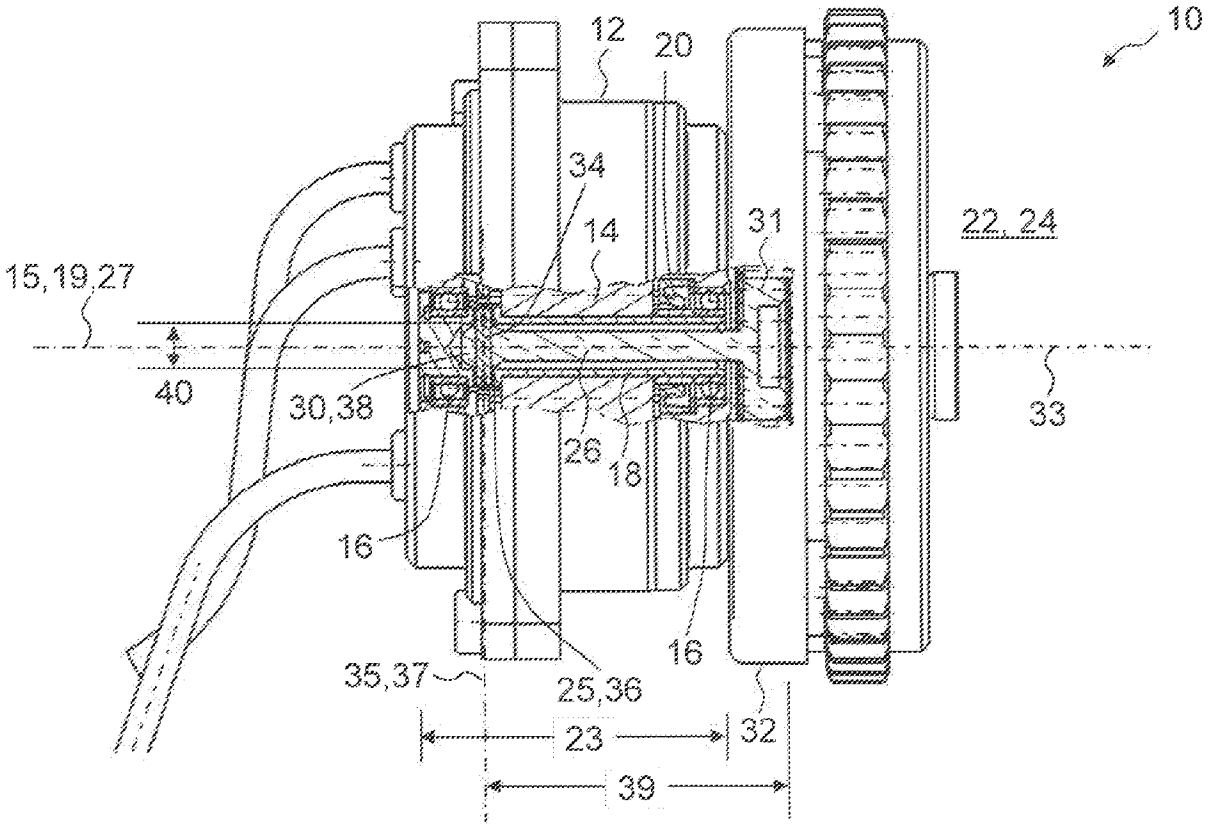
FIG. 1 schematically illustrates a partial sectional side view of a camshaft controller in accordance with a first embodiment of the invention.
Figure 2:
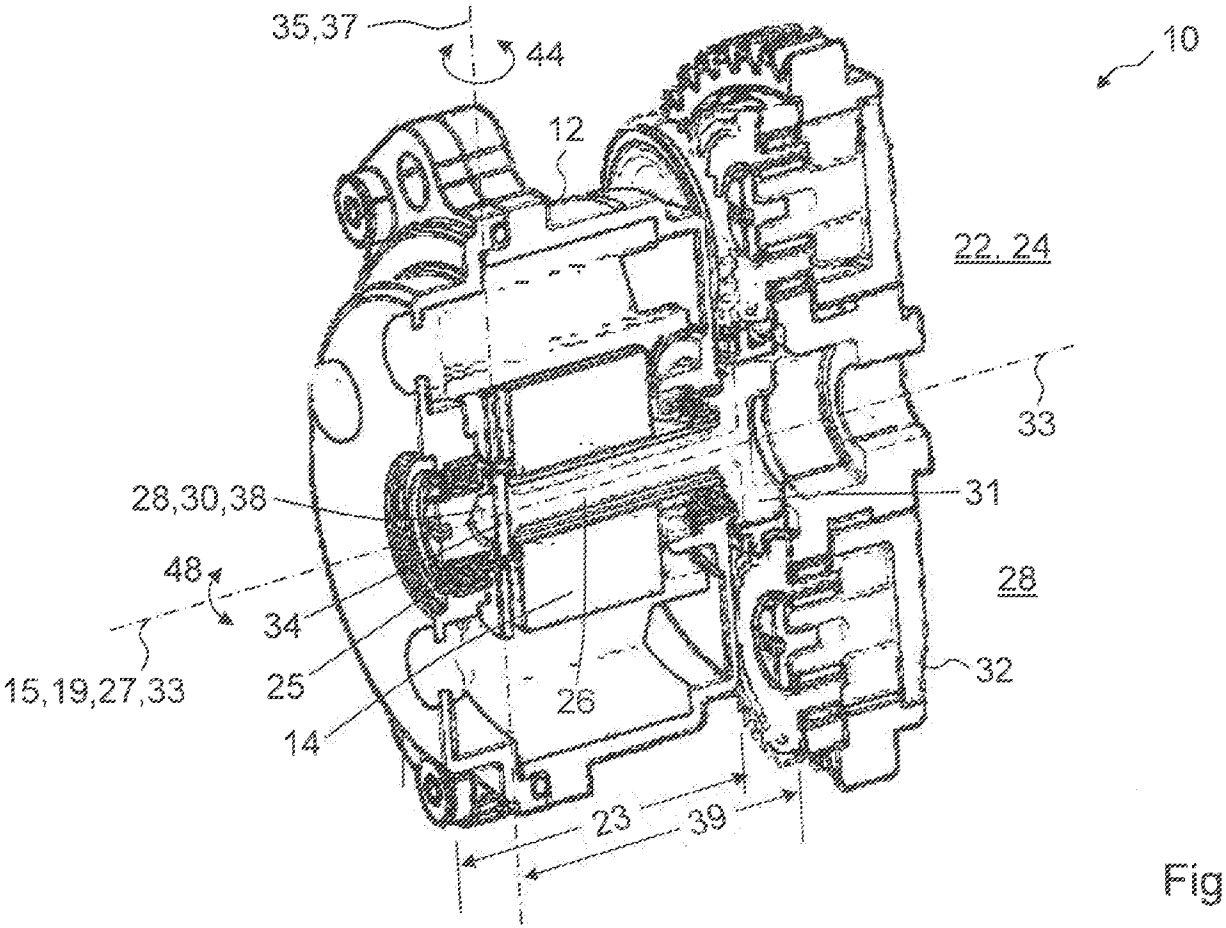
FIG. 2 schematically illustrates a perspective side cross-sectional view of the first embodiment of the camshaft controller in accordance with the first embodiment of the invention.

Camshaft controller 10 shown in FIGS. 1 and 2 comprises a servomotor 12 and an adjustment transmission 32. Servomotor 12 can be, for example, an electric machine (electric motor), a hydraulic drive or a pneumatic drive. Servomotor 12 includes a rotor 14 which is mounted in two rotor bearings 16. Rotor 14 includes a hollow shalt 18 which is surrounded by a radial shaft sealing washer 20 which helps to seal off oil-filled camshaft chamber 22 from parts of servomotor 12. Parts 26, 32, on the camshaft side, of camshaft controller 10 are typically located under engine oil 24. A clutch shaft 26 is guided through hollow shaft 18 and is fastened to rotor 14 on that side of rotor 14 which faces away from adjustment transmission 32. Clutch shaft 26 can extend over more than 50% of a (total) axial length of a rotor 14.

At an end 30 of the clutch shaft 26 on the servomotor side, clutch shaft 26 is articulated at rotor 14 by way of a fastening bolt 34 for a transmission of torque to adjustment transmission 32. Clutch shaft 26 has at its end 30 on the servomotor side a passage 25 for a fastening bolt 34. Fastening bolt 34 is mounted in opposing holes 36 in the wall of hollow shaft 18. In the region of passage 25 for fastening bolt 34, clutch shaft 26 can have a spindle-shaped or spherical thickening 38, the outer diameter of which is only slightly smaller than inner diameter 40 of hollow shaft 18. As a result of this, it is achieved that clutch shaft 26 (independently of its gyrating motion) is fastened in hollow shaft 18 such that, at the location of fastening bolt 34, a main longitudinal axis 27 of clutch shaft 26 has a common point of intersection 42 with the main longitudinal axis 19 of hollow shaft 18.

Fastening bolt 34 is rotatably mounted in hollow shaft 18 about its main longitudinal axis 35. As illustrated in FIG. 2, such a rotation is a rolling motion 44 of fastening bolt 34. Moreover, fastening bolt 34 is mounted in hollow shaft 18 with so much play that it can be tilted with respect to an axis 37 of holes 36. Such a tilting 48 is a pitch motion of fastening bolt 34. Due to the fact that fastening bolt 34 can perform both a rolling motion 44 and a pitch motion 48 in hollow shaft 18, clutch shaft 26 can (relative to point of intersection 42 of main longitudinal axes 19, 27) be tilted in any radial direction, i.e., can gyrate. In order to support clutch shaft 26 in the axial direction or pretension it against adjustment transmission 32, clutch shaft 26 can include on at least one of its two face sides 30, 31 a cylinder-symmetrical, convex formation 28 which is arranged concentrically with respect to main longitudinal axis 27 of clutch shaft 26.

Figure 3:
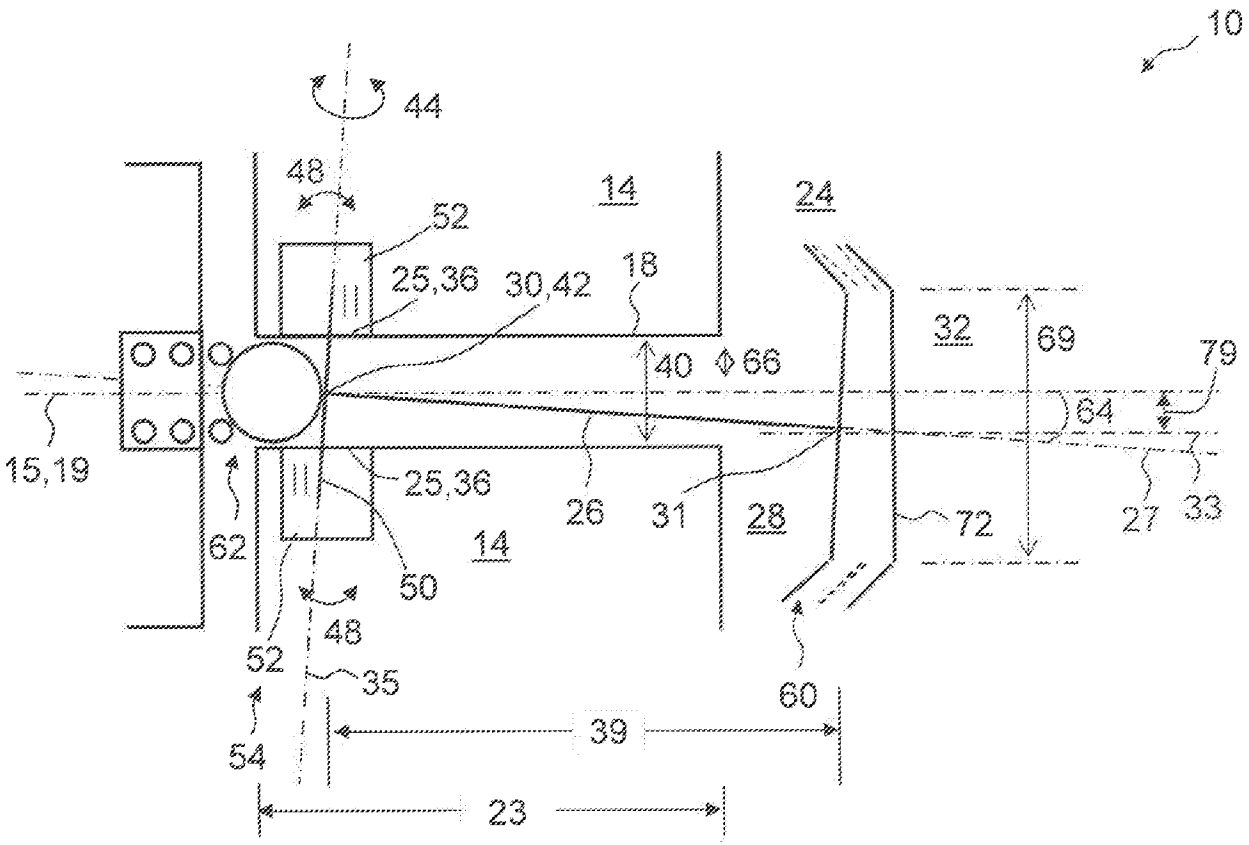
FIG. 3 schematically illustrates, in a side view, a basic concept of the axial offset equalization in accordance with the first embodiment of the invention.

As illustrated in FIG. 3, a (disc-shaped) securing flange 50 can be clamped between elastomer discs 52 which are arranged concentrically on rotor side 54. As a result of this arrangement, clutch shaft 26 can, during rotation of rotor 14, perform an even or smooth gyrating motion. Instead of a securing flange 50, several projections can also be fixed or formed on clutch shaft 26, which projections point, for example, in multiple (e.g., 3, 4 or 5) circumferential directions. On other side 31 of clutch shaft 26, a bevel gear 60 of clutch shaft 26 engages in a bevel gear 72 of adjustment transmission 32. As a result of the mutual self-centering of bevel gears 60, 72 and the pressure of spring-supported bevel support 62, the teeth of both bevel gears 60, 72 remain in undetectable engagement despite the axial angle 64 between clutch shaft 26 and adjustment transmission 32.

Dashed lines indicate ridges of the interengaging teeth of bevel gears 60, 72. FIG. 3 also illustrates that adequate play 66 can be provided between clutch shaft 26 and hollow shaft 18 so that enough free space is left for clutch shaft 26 for the necessary gyrating motion. To this end, clutch shaft 26 can be tapered between its two ends 30, 31 across more than w % of its axial length 39, wherein w % is at least 30%, in particular at least 60%. In the case of corresponding axial offset 79, the shown angle arrangement can not only be apparent in a side view, rather also from the view of each different circumferential angle of the main longitudinal axis of rotor 14.

Figure 4:
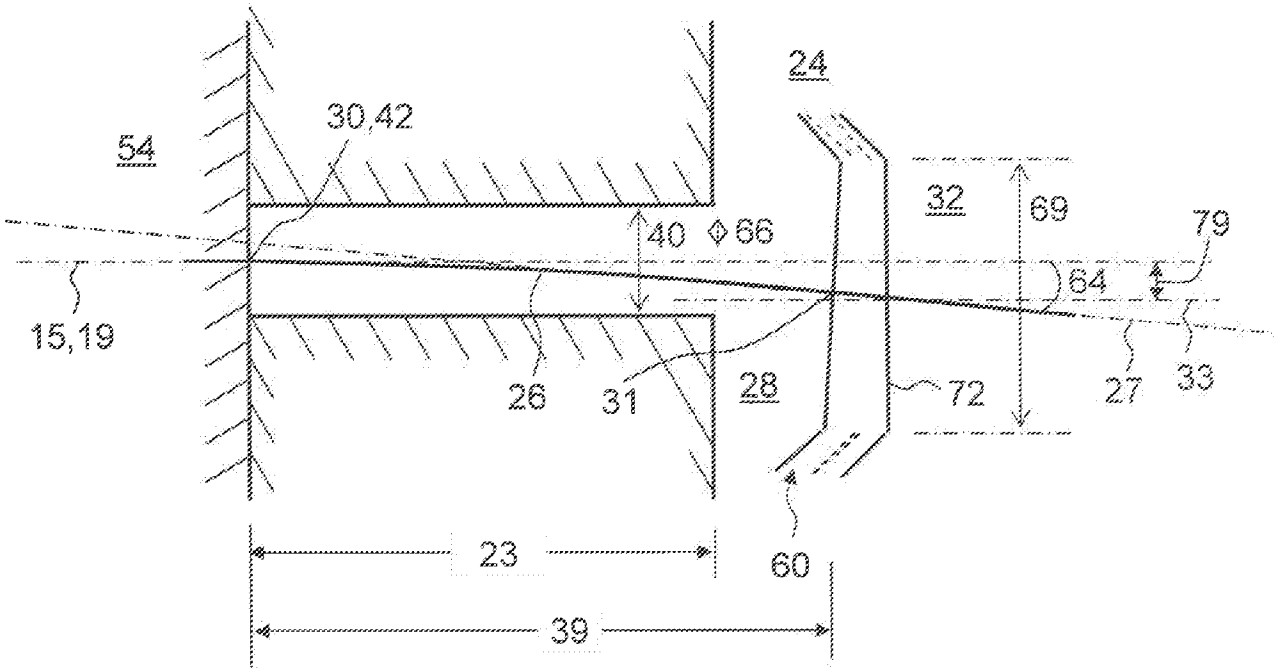
FIG. 4 schematically illustrates, in a side view, a basic concept of the axial offset equalization in accordance with a second embodiment of the invention.

As illustrated in FIG. 4, clutch shaft 26 can also be fastened rigidly to rotor 14 if it has sufficient flexibility along with simultaneously adequate torsional strength. In the case of a circular or ring-shaped cross-section of clutch shaft 26, an increase in flexibility typically equally involves an increase in torsional strength. Depending on the application, it can, however, also be the case that (for example, as a result of a speed reduction) a twisting of flexible clutch shaft 26 is not disruptive. Or an attempt can be made by selection of a material with a suitable Poisson's ratio, by selecting an anistropic material or by an anisotropic structure of the clutch shaft to adjust the ratio of flexural stiffness to torsional strength to concrete application requirements. In the case of corresponding axial offset 79, the shown angle arrangement can not only be produced in a side view, but also from the perspective of any other circumferential angle of the main longitudinal axis of rotor 14.

Figure 5:
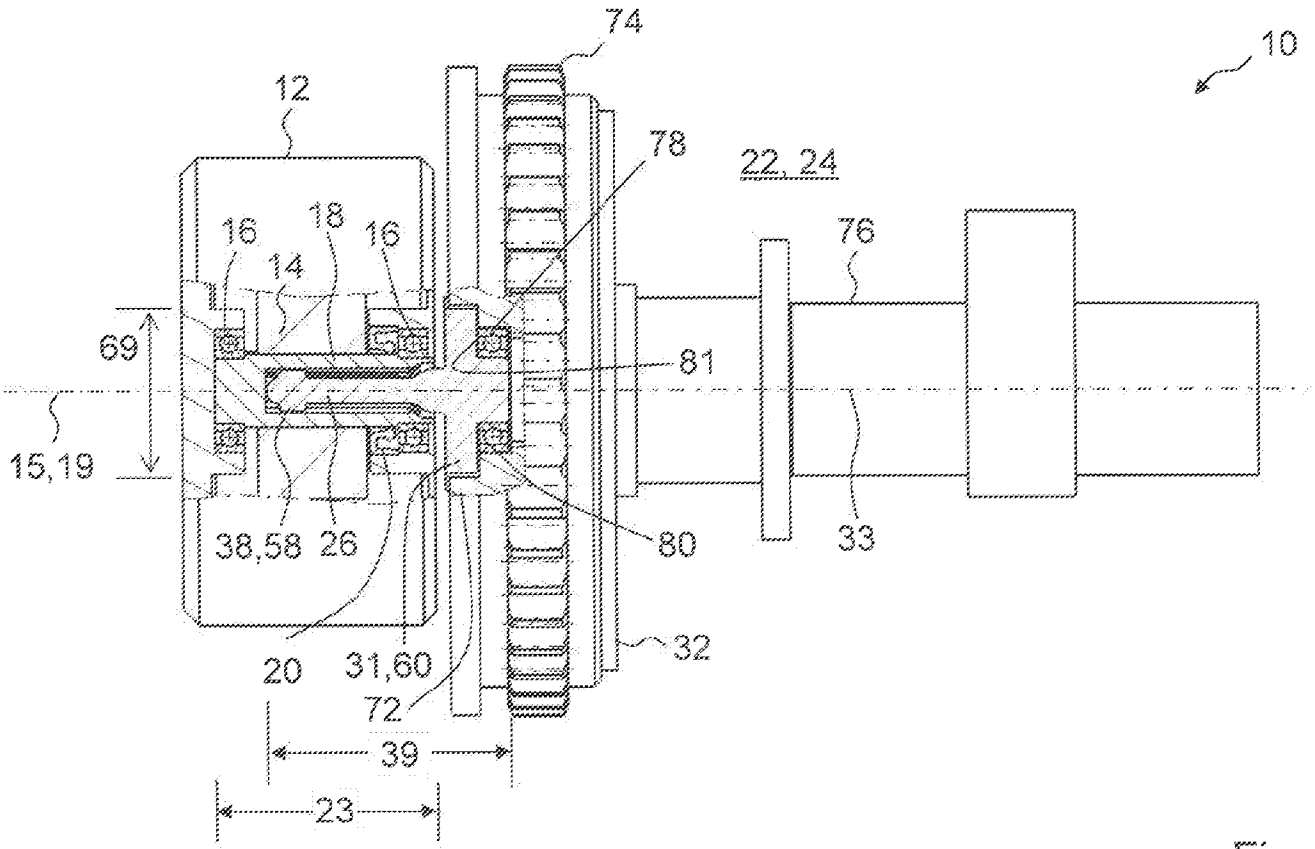
FIG. 5 schematically illustrates a partial sectional side view of a camshaft controller with a clutch shaft in accordance with a third embodiment of the invention.
Figure 6:
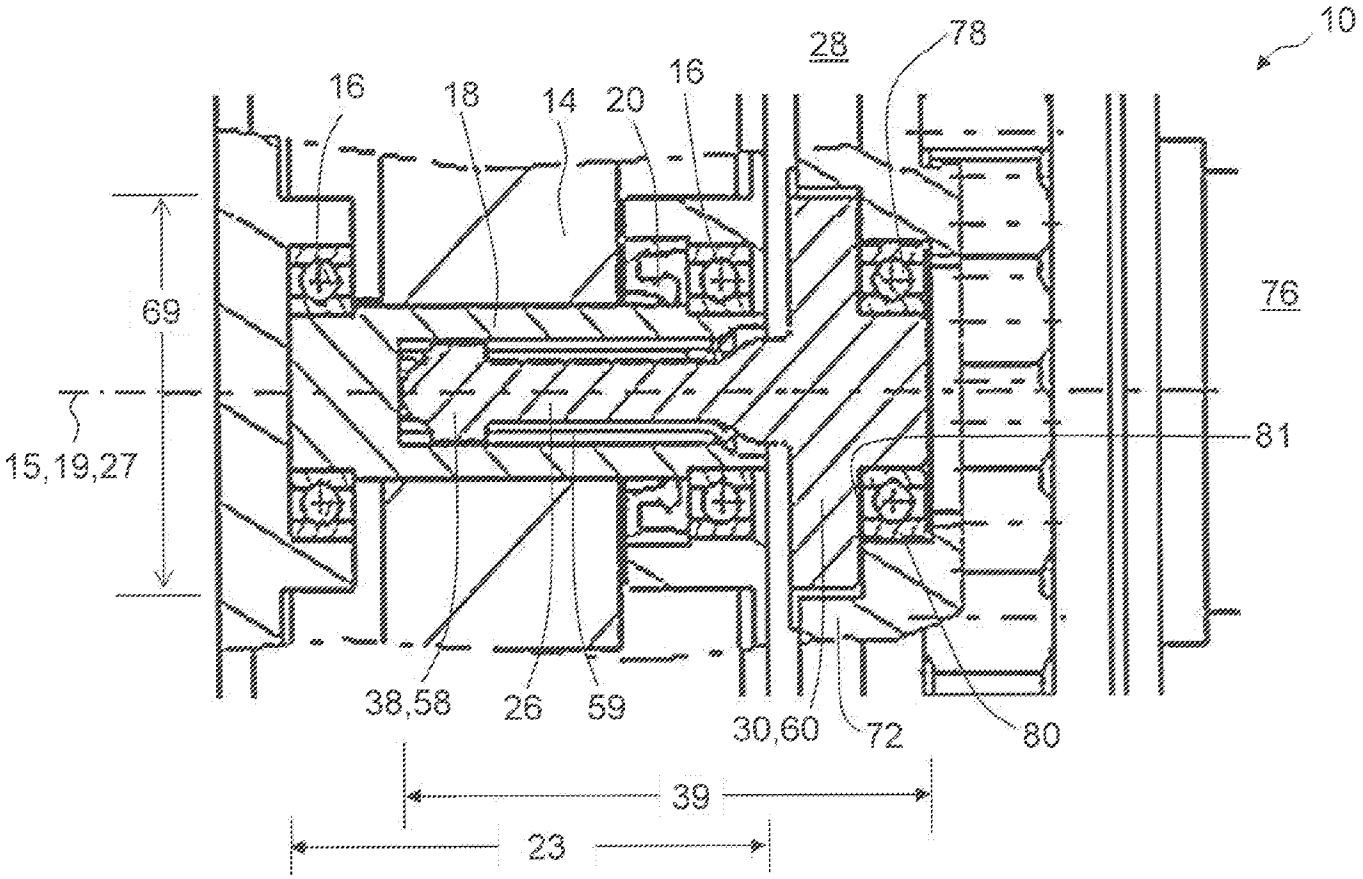
FIG. 6 schematically illustrates a detailed side cross-sectional view of the camshaft controller in accordance with the third embodiment of the invention.

As illustrated in FIGS. 5 and 6, clutch shaft 26 has, on the servomotor side, an arcuate denture clutch component 58. Arcuate toothing enables an angling of clutch shaft 26 with respect to a main longitudinal axis 15 of rotor 14 and hollow shaft 18. Independently of this, inner toothing 59 of hollow shaft 18 enables an axial positional adjustment of clutch shaft 26 along main longitudinal axis 19 of hollow shaft 18. Clutch shaft 26 illustrated FIGS. 5 and 6 also comprises on the side of adjustment transmission 32 an arcuate denture clutch component 60 which engages in an inner crown gear of a transmission drive gearwheel 72 of adjustment transmission 32. Arcuate denture clutch component 60 has here a larger diameter 69 because transmission drive gearwheel 72 is located at a point at which, during assembly, a fastening screw for adjustment transmission 32 with chain wheel 74 at which camshaft 76 is to be guided through.

As already explained in relation to FIG. 3, clutch shaft 26 can also be pressed or otherwise biased by way of spring force in the direction of adjustment transmission 32 in the case of the third embodiment. End 31, which points towards camshaft 76, of clutch shaft 26 can be supported by a self-aligning bearing in adjustment transmission 32 (for example, on an intermediate gearwheel) or alternatively against camshaft 76. End 31 of clutch shaft 26 can be mounted on a ball bearing 78 which has a spherical outer ring 80 such that it can be slightly angled in the case of axial offset 79 with respect to main axis 33 of adjustment transmission 32. Clutch shaft 26 can have a flange 81 on which ball bearing 78 is fastened. Ball bearing 78 can lie within a crown gear 72. It can be supported on a pin of camshaft 76.

Figure 7:
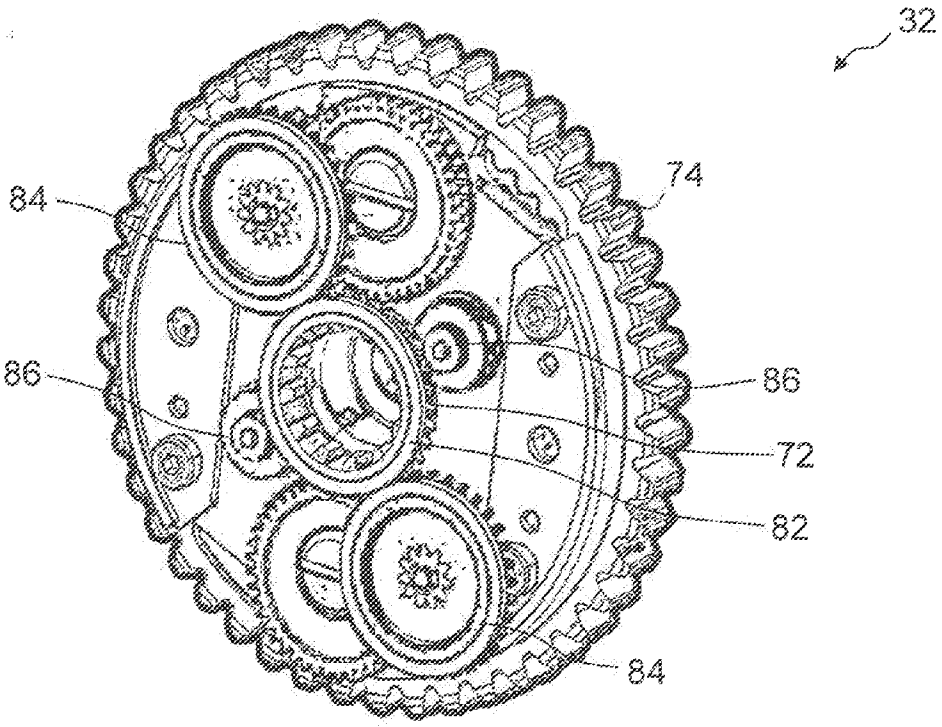
FIG. 7 schematically illustrates a perspective view of an open camshaft adjustment transmission with a floating transmission drive gearwheel.

FIG. 7 illustrates a perspective view of an open adjustment transmission 32 with transmission drive gearwheel 72. Transmission drive gearwheel 72 is embodied here as a floating gearwheel and has an inner toothing and an outer toothing. Transmission drive gearwheel 72 serves to drive an adjustment shaft of adjustment transmission 32 via a speed reduction with intermediate gearwheels 84. Flanges 82 on transmission drive gearwheel 72 and on intermediate gearwheels 84 retain transmission drive gearwheel 72 at the axial position between intermediate gearwheels 84. In relation to the direction perpendicular to the axial connection of intermediate gearwheels 84, transmission drive gearwheel 72 is retained by guiding wheels 86. Independently of this, transmission drive gearwheel 72 should also be adequately fixed or mounted in the axial direction. This can be achieved, for example, by sliding bearing surfaces or by a ball bearing.

In accordance with embodiments of the present invention, a clutch shaft 26, an actuator 12, a camshaft adjustment transmission 32 and a camshaft controller 10 are provided, with which radial forces between the clutch and the transmission input shaft can be reduced or prevented. This applies in particular in combination with a floatingly mounted transmission input shaft (transmission drive gearwheel 72). Independently of this, the space-saving design enables a reduction in the axial installation space requirement for camshaft controller 10. Installation space which can be saved for the clutch by servomotor 12 with adjustment transmission 32 enables the use of a lower cost adjustment transmission 32 or a lower cost servomotor 12.

Although embodiments have been described herein, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A clutch shaft for a camshaft controller, the clutch shaft comprising:

a clutch shaft body having a first end and a second end, each one of the first end and the second end having a rotating joint to permit coupling of the clutch shaft to an actuator of the camshaft controller and which equalizes the angle between the axes in a region of the actuator which faces away from an camshaft adjustment transmission of the camshaft controller.

2. The clutch shaft of claim 1, wherein an axial length of the clutch shaft body is greater than at least 130% of a maximum diameter of the clutch component.

3. The clutch shaft of claim 1, wherein an axial length of the clutch shaft body is greater than at least 150% of a maximum diameter of the clutch component.

4. The clutch shaft of claim 1, wherein the clutch shaft body is tapered between the first end and the second end across more than at least 30% of its axial length.

5. The clutch shaft of claim 1, wherein the clutch shaft body is tapered between the first end and the second end across more than at least 60% of its axial length.

6. The clutch shaft of claim 1, further comprising, on at least one face of the clutch shaft body, a cylinder-symmetrical, convex formation which is arranged concentrically with respect to the main longitudinal axis of the clutch shaft body.

7. The clutch shaft of claim 1, further comprising a flange for a bearing.

8. The clutch shaft of claim 1, wherein:

the rotating joint on the first end of the clutch shaft body which equalizes the angle between the axes comprises at least one of a fastening bolt and a component one of a denture clutch, a claw clutch, a plug clutch, a driver clutch, a radial gearwheel clutch, a disc gearwheel clutch, a flexible disc, a bellows clutch, an elastomer clutch, a helix clutch, a spring clutch, a spring disc clutch, a fixed link clutch, a balancing clutch, a cardan transmission and a homokinetic joint; and the rotating joint on the second end of the clutch shaft body which equalizes the angle between the axes comprises a fastening bolt and a component one of a denture clutch, a claw clutch, a plug clutch, a driver clutch, a radial gearwheel clutch, a disc gearwheel clutch, a flexible disc, a bellows clutch, an elastomer clutch, a helix clutch, a spring clutch, a spring disc clutch, a fixed link clutch, a balancing clutch, a cardan transmission and a homokinetic joint.

9. An actuator for controlling a camshaft adjustment transmission, the actuator comprising:

an actuator body;

a clutch shaft configured to control the camshaft adjustment transmission, the clutch shaft being coupled to the actuator body via a first rotating joint which equalizes the angle between the axes in a region of the actuator body which faces away from the camshaft adjustment transmission.

10. The actuator of claim 9, further comprising a rotor, wherein the clutch shaft extends across more than 50% of an axial length of the rotor.

11. The actuator of claim 9, wherein:

the clutch shaft is arranged in the actuator body rotatably in a pitch direction on each circumferential angle; and a pitch angle of the clutch shaft with respect to an axis of the actuator body can be up to at least 3°.

12. The actuator of claim 9, wherein the clutch shaft is arranged axially displaceably in the rotor.

13. The actuator of claim 9, further comprising an axial bearing component configured to pretension the clutch shaft in a direction of a main longitudinal axis of the clutch shaft.

14. The actuator of claim 9, wherein the first rotating joint comprises at least one of a fastening bolt, and a component of a denture clutch, a claw clutch, a plug clutch, a driver clutch, a radial gearwheel clutch, a disc gearwheel clutch, a flexible disc, a bellows clutch, an elastomer clutch, a helix clutch, a spring clutch, a spring disc clutch, a fixed link clutch, a balancing clutch, a cardan transmission and a homokinetic joint.

15. A camshaft adjustment transmission comprising:

an adjustment shaft;

a chainwheel at which the camshaft is guided through;

a transmission drive gearwheel having an inner toothing and an outer toothing and configured to drive the adjustment shaft of adjustment transmission via a speed reduction with a intermediate gearwheels, wherein one of the inner tooting and the outer toothing comprises a denture clutch component.

16. The camshaft adjustment mechanism of claim 15, wherein the transmission drive gearwheel comprises a floating gearwheel.

17. The camshaft adjustment mechanism of claim 15, wherein a first flange on the transmission drive gearwheel and second flanges on the intermediate gearwheels are each configured to retain the transmission drive gearwheel at an axial position between the intermediate gearwheels.

18. The camshaft adjustment mechanism of claim 15, further comprising guiding wheels configured to retain the transmission drive gearwheel on the chain wheel.

19. The camshaft adjustment transmission of claim 15, wherein the denture clutch component forms a floating transmission drive gearwheel.

* * * * *